US005363007A

United States Patent [19]

Fromm et al.

[11] Patent Number: 5,363,007

[45] Date of Patent: Nov. 8, 1994

[54] LOW-POWER, HIGH-PRESSURE DISCHARGE LAMP, PARTICULARLY FOR GENERAL SERVICE ILLUMINATION USE

[75] Inventors: Dietrich Fromm, Warngau; Andreas Hohlfeld, Berlin; Guenter Soehring, Munich, all of Germany

[73] Assignee: Patent-Treuhand-Gesellschaft fuer Elektrische Gluehlampen mbH, Munich, Germany

[21] Appl. No.: 920,782

[22] Filed: Jul. 28, 1992

[30] Foreign Application Priority Data

Sep. 30, 1991 [DE] Germany ..... 4132530

[51] Int. Cl.[5] ..... H01J 61/20

[52] U.S. Cl. ..... 313/25; 313/44; 313/45; 313/113; 313/571; 313/620; 313/635; 313/639; 313/642; 313/643

[58] Field of Search ..... 313/25, 44, 45, 47, 313/113, 635, 640, 641, 638, 620, 571, 642, 639; 362/296

[56] References Cited

U.S. PATENT DOCUMENTS

| | | | |
|---|---|---|---|
| 3,514,659 | 5/1970 | Gungle et al. | 313/641 |
| 3,842,307 | 10/1974 | Dobrusskin et al. | 313/635 |
| 3,852,630 | 12/1974 | Wesselink et al. | 313/640 |
| 3,979,624 | 9/1976 | Liu et al. | 313/639 X |
| 4,155,025 | 5/1979 | Dobrusskin et al. | 313/642 X |
| 4,171,498 | 10/1979 | Fromm et al. | 313/641 |
| 4,594,529 | 6/1986 | de Vrijer | 313/634 |
| 4,709,184 | 11/1987 | Keeffe et al. | 313/638 |
| 4,866,342 | 9/1989 | Ramaiah et al. | 313/639 |
| 4,890,030 | 12/1989 | Keeffe et al. | 313/25 |
| 4,948,530 | 8/1990 | Barthelmes et al. | 252/520 |
| 5,239,232 | 8/1993 | Heider et al. | 313/639 |

FOREIGN PATENT DOCUMENTS

| | | | |
|---|---|---|---|
| 0173235 | 3/1986 | European Pat. Off. . | |
| 0215524 | 3/1987 | European Pat. Off. . | |
| 0220633 | 5/1987 | European Pat. Off. . | |
| 0276514 | 8/1988 | European Pat. Off. . | |
| 0399288 | 11/1990 | European Pat. Off. . | |
| 2270673 | 12/1975 | France . | |
| 2373157 | 6/1978 | France . | |
| 2627627 | 8/1989 | France . | |
| 0292848 | 10/1992 | Japan | 313/638 |

OTHER PUBLICATIONS

"Technisch-wissenschaftliche Abhandlungen der Osram-Gesellschaft (Technological-Scientific Papers" of the Osram Company, published by Springer, Berlin-Heidelberg-New York-Tokyo, 1986, article by Dobrusskin, Fromm and Heider, vol. 12, pp. 10 through 19.

*Primary Examiner*—Donald J. Yusko
*Assistant Examiner*—Ashok Patel
*Attorney, Agent, or Firm*—Frishauf, Holtz, Goodman & Woodward

[57] ABSTRACT

To provide a fill in a low-power, high-pressure discharge lamp, which is capable of emitting light within a warm white light (WDL) color or neutral white light (NDL) color, that is, in the ranges of between about 2600 to 4600K, the fill has a relative relationship of sodium halide to scandium halide between 5:1 and 24:1, a relationship of sodium halide to thallium halide of 25:1 to 73:1, and a heat damming or heat retention or reflection coating (15, 16) is located at the end caps of the generally bulbous discharge vessel to provide for a cold spot temperature (Tc) of at least 800° C., and preferably higher.

20 Claims, 2 Drawing Sheets

LOW-POWER, HIGH-PRESSURE DISCHARGE LAMP, PARTICULARLY FOR GENERAL SERVICE ILLUMINATION USE

Reference to related patents, the disclosures of which are hereby incorporated by reference:

U.S. Pat. No. 3,842,307, Dobrusskin et al
U.S. Pat. No. 4,171,498, Fromm et al
U.S. Pat. No. 4,594,529, Vrijer
U.S. Pat. No. 4,709,184, Keeffe et al
U.S. Pat. No. 4,890,030,
U.S. Pat. No. 4,866,342, Ramaiah et al
U.S. Pat. No. 4,948,530, Barthelmes et al.
U.S. Ser. No. 07/689,155, filed Apr. 22, 1991, Heider et, now U.S. Pat. No. 5,239,232, Aug. 24, 1993.

Reference to related publications:

European Patent Specification 0 215 524, Meulemans et al
European Patent Specification 0 220 633, Gilliard et al
Publication "Technisch-wissenschaftliche Abhandlungen" ("Technological-Scientific Papers") of the Osram Company, published by Springer, Berlin-Heidelberg-New York-Tokyo 1986, article by Dobrusskin, Fromm and Heider, Vol. 12, pages 10 through 19.

FIELD OF THE INVENTION

The present invention relates to high-pressure discharge lamps, and more particularly to high-pressure discharge lamps of low power, suitable for general service illumination, that is, in power ranges of between about 35 to 200 W, and especially to metal halide discharge lamps which provide light output in a warm white light color (WDL) or neutral white light color (NDL), corresponding to a color temperature of between about 2600–4600K.

BACKGROUND

Discharge lamps for general service illumination require a long lifetime of at least 6000 hours, coupled with good color rendition. Thus, such lamps must have a high Ra index and, for overall color rendition, a minimum value of $Ra_8=80$ is desirable. The red index, R9, which provides a measure of color rendition within the red spectral range is of particular importance. Heretofore it was not possible to provide lamps which have a satisfactory color rendition coupled with long lifetime.

The referenced Dobrusskin U.S. Pat. No. 3,842,307 describes a metal halide lamp which has a special fill designed to provide NDL, that is, neutral white light color. The fill includes sodium halides and various rare -earth halide additives. This fill, however, is not suitable for warm white light, that is, for WDL light, since the wall loading to obtain such a light color would be excessively high. Such high wall loading, in combination with the fact that the major portion of the rare-earth halides in the lamp are present as condensates, substantially decreases the lifetime. Condensates within the lamp lead to devitrification of the light bulb, due to chemical reaction of the fill substances with the quartz glass of the bulb.

It has been proposed to utilize a fill for a lamp which provides WDL light, including a sodium tin fill—see the referenced U.S. Pat. No. 4,171,498. This lamp, however, does not provide satisfactory color rendition and the incomplete removal of undesired residual gases has led to excessive corrosion of the electrodes.

A pure sodium-scandium fill as proposed in U.S. Pat. No. 4,890,030 has long lifetime, that is, an operating rated life of over 6000 hours. The color rendition characteristics, however, are poor. This lamp has been used widely in the U.S. due to its long lifetime in spite of the overall color rendition index $Ra_8$ of only about 70 and an R9 of −90.

Various additives-to the sodium-scandium system have been tested, particularly halides of thorium (see European 0 220 633, Gilliard et al) and of thallium. U.S. Pat. No. 4,866,342, Ramaiah et al, describes a lamp providing color temperatures between 3800 and 4600K., corresponding to the NDL light color, and designed for high power, that is, 400 W and over. This lamp uses a fill with a molar relationship of sodium halide: scandium halide of 25:1 to 50:1; and a proportion of sodium halide to thallium halide of 75:1 to 280:1.

U.S. Pat. No. 4,594,529 recommends similar relationships for use in an automotive discharge lamp which, typically, has a color temperature of about 4500K., that is, neutral white. The color rendition, actually, is not important in this type of application.

It has been tried to improve the sodium-scandium system, for example by the addition of elementary scandium, see U.S. Pat. No. 4,709,184, or coating of the discharge vessel, see European 0 220 633 and the U.S. Pat. No. 4,709,184; alternatively, evacuating of an outer envelope or vessel and addition of a heat retention or heat damming tube has been suggested, see U.S. Pat. No. 4,890,030.

The European Specification 0 215 524, Meulemans et al, is directed to obtaining a lamp having reasonably good color rendition and low color temperature, corresponding to the WDL or warm white color standard. This lamp is based on a sodium-thallium system with, possibly, addition of rare earths, including scandium. The wall loading of such a lamp, however, is very high, for example equal to or over 25 W/cm$^2$, and typically 60 W/cm$^2$. This high wall loading requires a ceramic discharge vessel. It is necessary to maintain specific geometrical relationships with respect to the discharge vessel volume and the electrode arrangement. While this patent describes a theoretically interesting solution, it is undesirable from a practical point of view since it requires ceramic material involving an entirely new technology of lamp manufacture, thus substantially increasing the costs of the lamp, and introducing additional manufacturing problems. These problems relate, especially, to long-term sealing and tightness of the connecting leads to the electrodes and accessory elements as well as the development of glass melts or glass solders which are resistant to halides.

It has not been possible, heretofore, to find a satisfactory solution to-the development of a gas discharge lamp of low power which, at the same time, has long lifetime as well as good color rendition, and thus is suitable for general-service use, such as interior illumination of living areas and stores, offices and the like. The problem appears to be that the desired characteristics of the lamp are, technically, mutually exclusive and that, further, light output deteriorates as the color rendition index becomes better and increases.

THE INVENTION

It is an object to provide a high-pressure discharge lamp with a metal halide fill, and especially such a lamp of small power rating suitable for general-service use, that is, of a power rating of between about 35 to 200 W, which, at the same time, has a relatively low color temperature, a good color rendition index, and additionally long lifetime, while, further, utilizing well known manufacturing technology, that is, technology in connection with quartz glass bulbs for the discharge vessel.

Briefly, the gas discharge vessel is retained within a transparent glass envelope which contains the usual electrodes and current supply leads carried thereto. The bulb or discharge vessel retains an ionizable fill of mercury, a noble gas, and at least halides of sodium, scandium and thallium. In accordance with a feature of the invention, the relationship between the proportions of the sodium halide and other halides are carefully selected, namely the mol relationship between the components of sodium halide and scandium halide is between about 5:1 to 24:1; the mol relationship between sodium halide and thallium halide is between about 25:1 to 73:1; and, further, a reflection coating is provided on the discharge vessel so that the heat retention or heat damming effect is enhanced, preferably by providing the reflection coating throughout the end caps of the somewhat bulbous discharge vessel.

In accordance with a feature of the invention, a compromise has been found which reconciles the contradictory requirements of long lifetime and good color rendition. The individual technical characteristics have been known for a long time; the interrelationship of the respective elements, however, is complex and non-linear, and the optimum combination, in accordance with the invention, has heretofore eluded researchers.

Basic to the present invention is not only the selection of the fill components but also the relative proportions thereof. Additional advantages can be obtained by suitable selection of all the materials and of the geometrical dimensions of the bulb or the discharge vessel as such.

It has been found, in accordance with a feature of the invention, that by careful selection of the components of the fill, it is possible to increase the wall loading of the discharge vessel, even while maintaining the manufacture and material of the discharge vessel to be quartz glass, made in accordance with well known quartz-glass manufacturing technology. It is, thus, possible to use wall loading which is higher than heretofore thought possible by the industry. Previously, a wall loading limit of about 20 W/cm$^2$ was considered the upper possible loading, as discussed, for example, in the "Technischwissenschaftliche Abhandlungen" ("Technological-Scientific Papers") of the Osram Company, published by Springer, Berlin-Heidelberg-New York-Tokyo 1986, article by Dobrusskin, Fromm and Heider, Vol. 12, pages 11 through 19. A particularly pertinent discussion is found on Table 3 of page 15 of this publication, which is directed to a maximum wall loading of 19 W/cm$^2$ in connection with a 70 W lamp. U.S. application Ser. No. 07/689,155, filed Apr. 22, 1991, Heider et al, also considered wall loading as a limiting factor. As the power rating increases, the wall loading decreases. Heat losses are thus compensated in small lamp dimensions. For power ratings below 100 W, the wall loading is particularly critical. Yet, this is the power rating of many lamps suitable for interior general-service illumination.

In accordance with a feature of the invention, research was thus directed to a fill system which, in operation of the lamp, results in low deposits or condensates within the lamp formed of aggressive material. It has been found, in accordance with the invention, that just such condensates additionally stress the material of the discharge vessel or bulb, and thus decrease the lifetime by causing devitrification. The generally well tested Na-rare earth system is unsuitable since, in order to obtain long lifetime, it must be operated in saturation, so that a condensate or bottom deposit of about 90% of the fill material will form. Similarly, a saturated Na—Sc system, as described in European 0 220 633, is not suitable to obtain long lifetime.

Highly surprisingly, it has been found that the Na—Sc system, which is well known in connection with lamps which have poor color rendition (Ra=70) but good basic conditions, can be improved to obtain the results desired, namely good color rendition and long lifetime, while utilizing quartz glass technology, by adding thallium. The Na—Sc—Tl system, however, can meet the requirements only when, and departing from prior dosing or relative relationship, a mol relationship of between sodium halide to scandium halide of about 5:1 to 24:1 and of sodium halide to thallium halide of about 25:1 to 73:1 is used. This is in substantial contrast to the prior art, where mol relationships of sodium halide to scandium halide of 25:1 to 50:1, and sodium halide to thallium halide of 75:1 to 280:1 were used.

A preferred molar relationship, in accordance with the present invention, is sodium halide (hereinafter abbreviated Na—H) to scandium halide (hereinafter abbreviated Sc-H) of between 5:1 to 22:1, and especially 5:1 to 19:1; and of Na—H to thallium halide (hereinafter abbreviated T1—H) of 25:1 to 73:1. As can be seen, the sodium content is decreased. A Na—Sc relationship below 25:1 leads to an increase in lifetime because the Na—Sc—$X_4$ complex, wherein X is a halogen, is present in unsaturated condition when the lamp is operating. This complex is essential for generation of the light and also, however, equally causes devitrification of the bulb. The Na—Sc—$X_4$ complex, in operation of the lamp, thus is completely vaporized. It is thus not available for a reaction to occur between the wall and the fill, which reaction, however, is the one leading to devitrification. This fill material thus is not available in form of a condensate. A condensate, however, will occur at the bottom of the bulb formed of a sodium halide, particularly NaI, which, however, has no role in the devitrification process.

The present invention is based, essentially, on the discovery of the different roles the various sodium compounds have with respect to the reaction of the fill with the wall, and the consequences resulting therefrom, while still maintaining the desired light, both as far as color and as far as effectiveness is concerned. The result of this discovery is a lamp which operates under partially saturated conditions, and which is so constructed that a) it is saturated with respect to sodium halides;
b) it is unsaturated with respect to both the complex compound and to
   b1) scandium halide
   2) thallium halide; and
c) the sodium-scandium relationship is above 5:1, since it has been found that at a sodium-scandium relationship below 5:1, the desired color temperature could not be obtained.

In accordance with a feature of the invention, the reduced quantity of sodium is compensated in two ways:

A) increase to a suitable level of the cold spot temperature, in order to obtain a uniform warm-white light color. This is obtained by a reflection coating, and, especially, by heat damming or heat retention coatings at both ends of a double-ended or double pinch sealed discharge vessel;

B) use of thallium in a special relationship or dosing so that the mol relationship of sodium to thallium is at or above 25:1 and up to and below 73:1.

With respect to increase of the cold spot temperature, condition A) above: The heat balance must be so optimized that the cold spot temperature Tc is in excess of 800° C. In accordance with the prior art, typical Tc values were between 600° to 800° C. for quartz glass; higher cold spot or Tc values were obtainable only with ceramic discharge vessels. The higher temperature can be obtained, in an astoundingly simple way, by substantially increasing the thickness of a heat damming or heat retention layer. This effect can be further increased by evacuating the space between an external envelope and the discharge vessel or arc tube or arc bulb. Under these conditions, the vapor density of the sodium becomes so high that the resonance line in the spectrum of the lamp at 589 nm is substantially spread, and the center line appears to be self-absorbed. This substantially increases the red rendition of the light, that is, the R9 index, by emission in the longer range wings of the resonance line. Particularly good results are obtained when the operating conditions are so selected that the spacing between the maximum values or tips of the two wings of the resonance line is about 7 to 12 nm.

With respect to the second feature B, the use of thallium: The purpose of the thallium is not so much in its direct contribution to improve the color rendition but, rather, it is present to function, in part, as an electron supplier, taking over in part the function of sodium as the electron supplier. This correspondingly decreases the ionization degree of the sodium vapor phase. A substantial proportion of the sodium thus is present as a neutral atom, further supporting the spreading of the sodium resonance line. The proportion of thallium is important, and the thallium additive is so dimensioned that the lamp—when it is burned-in, which occurs after about 100 hours of operation—is almost precisely on the Planck curve, and is in excellent harmony with other light sources. If the sodium-thallium proportion drops below 25:1, the lamp light would have a green hue, and a relationship above 73:1 has undesirable effects on the arc voltage and re-ignition.

For warm white light colors, it has been found particularly desirable to use iodine as the halide in a sodium-thallium relationship of between 25:1 and 50:1. For neutral white light color, an Na—T1 relationship of 40:1 to 73:1, particularly 50:1 to 73:1, is desirable and preferred. This is true both for a pure iodine halide additive or fill, as well as for mixed fills which utilize iodine and bromine.

The heat damming or heat retention effect can be increased and desirably affected by careful and suitable construction of the heat retention coating. The thickness of the coating, its purity and the spacing between coating portions at the two end caps or end regions of the bulb are important and determinative of good operation. Preferably, zirconium oxide or aluminum oxide, having a purity of at least 97%, are used—see U.S. Pat. No. 4,948,430. In the prior art, the specific dimensioning of the thickness of the layer has not been particularly considered. In accordance with the present invention, however, the thickness of the layer is important and it must be sufficiently large to be optically opaque. If aluminum oxide or zirconium oxide is used, the thickness should be at least 0.15 mm. The spacing of the end caps where the heat retention layers are applied is preferably so selected that it conforms approximately to the spacing of the electrodes and, preferably, between about 90 to 105% of the electrode spacing.

Preferably, the absolute dosing of the fill of the sodium-scandium-thallium system is between about 2.5 to 5.5 mg/cm$^3$, with respect to the interior volume of the discharge vessel. With such dosing, the system is just at the limit of saturation. A suitable halide is iodine, possibly with some proportion of bromine.

In the first 100 hours of operation, there will be some decrease or shrinkage of the fill. This results in a decrease of the Sc partial pressure, since the Sc, in contrast to the Na in the fill, has no additional supply from deposits within the lamp, for example the bottom of the lamp bulb. This results in a shift towards lower color temperatures. Consequently, it is recommended to add a slight quantity of elementary scandium for a compensation in order to decrease the color drift during the first few hours at the beginning of the operation of the lamp.

The color drift, during lamp operation, can also be decreased by partial use of bromine in the halides, and replacing the iodine up to about 70% thereof by bromine. Typical values of bromine are at about 30%, which value is somewhat independent of the light color. The use of bromine has been previously proposed as a theoretical alternative to pure fills of iodine, see U.S. Pat. No. 4,866,342, without, however, having found actual commercial acceptance. In accordance with a feature of the invention, the behavior of a mixed fill of bromine and iodine has been clarified and the particular use of mixed bromine and iodine, in the halides, appears to be particularly desirable.

Scandium bromide, $ScBr_3$, has a higher binding energy than scandium iodide, $ScI_3$. Due to the greater binding energy, undesirable interaction of the scandium halide with the quartz wall of the discharge vessel, resulting in formation of scandium oxide, is substantially decreased in a mixed fill. Bromine can be introduced in form of NaBr. During operation, however, a balance will form after dissociation so that, besides the initially present scandium iodide, $ScI_3$, also $ScBr_3$ will be formed. A combination of scandium dosing with a bromine-containing mixed fill is recommended particularly in case of high-wall loading, which is typical for low-watt lamp types and/or extremely good color rendition. The mechanism of loss of scandium appears to occur much faster at higher temperature, that is under the condition of high wall loading.

Adding bromine has the additional effect that the decrease in light flux, the decrease of color temperature and the drift of the color locus during the first 100 to 500 hours of operation could be improved by more than 50% over prior art lamps; in prior art lamps, the light flux decreased up to 30%, color temperature decreased up to 600K, and the drift of the color locus resulted in a decrease of the y-coordinate up to 10 hundredths points.

If only iodine is used as the halide in a sodium-scandium relationship of between 5:1 to 13:1 —with respect to the halides—in a preferred form, a higher value of the Na—Sc relationship is recommended if a mixture of iodine-bromine is used for the halides. Suitable values are up to 22:1, under some conditions up to 24:1. The reason appears to be that the addition of bromine results in a higher color temperature due to partial drop-off of absorption in the blue spectral range due to the iodine.

This must be compensated by an increase of the sodium-scandium relationship.

The color rendition index can additionally be improved by adding halides of zirconium and/or hafnium in a small quantity, for example in an overall quantity up to about 4 mol-% of the metal halide fill. Hafnium as well as zirconium improve the ignition and emission of the lamp; zirconium additionally also improves the R9 index, since it emits within the red spectral range.

Best operation and improvement of light color is obtained by optimizing the geometric shape and dimensions of the bulb. Surprisingly, it has been found that there is a non-linear relationship between electrode spacing and power rating. In the past, one had assumed that there was a linear relationship. Best results, in accordance with a feature of the invention, were obtained when the electrode spacing is proportional to the square root of the power rating, with a proportionality factor of 0.85 and a tolerance range of ±0.1. The electrode spacing, for the foregoing relationship, is in millimeter and power in watts, mathematically:

$$\text{electrode spacing } ES \text{ (in mm)} = 0.85\ (\pm 0.1) \times \sqrt{P} \text{ (watts)}.$$

Another important relationship is the dimension of the maximum interior diameter of the discharge vessel in relation to electrode space. Preferably, this relationship is between about 1.1 to 1.4, which is substantially above the level of previously typical values of 0.9. The term "maximum interior diameter" already implies that the discharge vessel, preferably, is bulged outwardly in the middle. A barrel shape for the discharge vessel is particularly suitable. It can be formed, alternatively, as an ellipsoid. The degree of bulging is preferably so selected that the effective median inner diameter is about 0.9 to 1.2 times the electrode spacing. The effective average inner diameter is defined as the square root of the inner volume, which is divided by the electrode spacing, see in this connection European Patent 0 215 524, Meulemans et al.

The lamp in accordance with the present invention has a specific advantage, namely that the arc voltage of about 100 V remains effectively constant, with good approximation, throughout the lifetime of the lamp. Another, and important advantage is that the spread or range of color temperature emitted by individual lamps is decreased. The lamp can be operated at any position, without noticeable change in color temperature. This makes a group of lamps particularly suitable for illumination of large areas, for example large halls or other spaces, where numerous lamps are installed. The difference in color temperature from individual lamps is effectively negligible.

The present invention, thus, provides high-pressure discharge lamps of generally low power, particularly suitable for interior illumination, providing a lifetime of about 6000 hours with a color rendition index RB equal to or greater than 80, R9 equal to or greater than −30, and in which the proportion of red light is increased from about 15% to more than 20%.

DRAWINGS FIG. 1 is a vertical schematic view of a double-ended, double-based high-pressure discharge lamp having a double-ended pinch-sealed discharge vessel; and FIG. 2 a spectral distribution diagram in which light output of a prior art 75 W lamp is shown in broken-line representation, and is contrasted with the light output of a 75 W lamp in accordance with the present invention in full-line representation.

DETAILED DESCRIPTION

Figure 1:
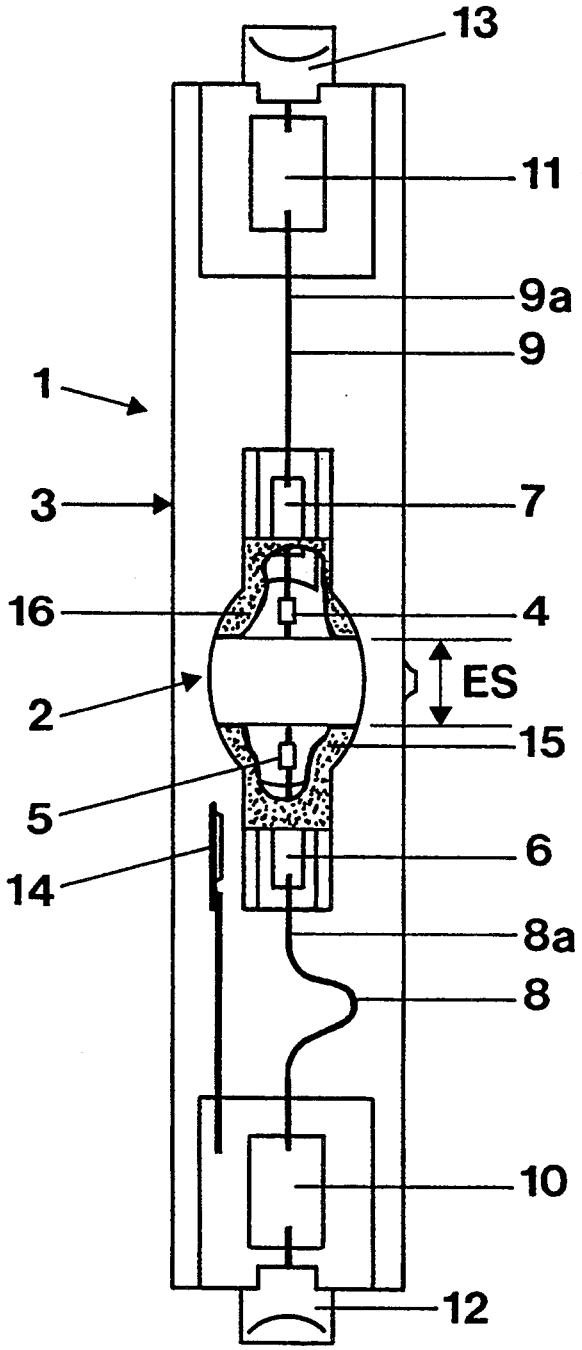

Referring first to FIG. 1:

The high-pressure discharge lamp illustrated is a 75 W lamp 1, having a double-sided pinch-sealed discharge vessel 2 of quartz glass, surrounded by a double-sided evacuated outer envelope 3, having external bases 12, 13 for connection into a suitable socket. The electrodes 4, 5 within the quartz glass discharge vessel 2 are shown only schematically. Connecting foils 6, 7 within the pinch seals air-tightly connect the electrodes to electrode supply leads 8, 9 which, in turn, are connected to sealing foils 10, 11 of the outer envelope 3, from which short electrical connections lead to the terminals of ceramic bases for placement in a standardized ceramic socket R7s. The current supply leads 8, 9 are surrounded by a fabric of quartz fibers, shown schematically at 8*a*, 9*a*, respectively, which suppresses the formation of photo electrons within the outer envelope 3. Providing such fabrics, braids or woven material, for example, may substantially increase the lifetime of the lamp beyond 6000 hours.

A getter connector is additionally melt-sealed in one of the outer envelope seals, to which a small plate with getter material 14 is attached. The connector is electrically isolated.

In accordance with a feature of the invention, a heat reflecting or heat damming or heat retention coating 15, 16 of zirconium dioxide is applied to the end caps of the discharge vessel 2. This coating 15, 16 has a thickness of about 0.2 mm. Its effect is to maintain The cold spot temperatures within the vessel over 800° C. and, preferably, substantially over 800° C. The coating forms two end caps or sphere caps. The inner terminals or edges of the coatings are located approximately at the level of the electrode tips. The electrode spacing, that is, the tip-to-tip spacing, is 7 mm, which, then, also corresponds to the spacing of the edges of the coating. This electrode spacing is shown as the dimension ES in FIG. 1.

The discharge vessel 2 is not cylindrical but, rather, is bulged outwardly in barrel shape. The generatrix of the barrel-shaped body is a circular arc having a radius of 11.1 mm. The inner length of the discharge vessel is 14 mm, and its interior volume is 0.69 $cm^3$. This results in a wall loading of up to about 22 $W/cm^2$. The quartz glass has a wall thickness of 1.3 mm.

EXAMPLE 1—75 W lamp as described above

The discharge vessel 2, in operation, emits light in a warm-white light color (WDL).

Fill:

- 16 mg mercury
- 120 mbar argon
- metal halide, total content 2 mg, in which the molar proportion of the overall metal halide is given in percent:
  - 89% NaI
  - 8.3% $ScI_3$
  - 2.7% TlI.
  - The foregoing proportions correspond to molar relationships of sodium halide to scandium halide of 11:1 and sodium halide to thallium halide of 33:1.

Light flux (after 100 hours), in comparison to a lamp with known fill with the halides of sodium, tin, thallium, indium and lithium is increased by 20% to 6000 lumens.

Light color: color temperature of 3000 K., warm white (WDL).

Luminous efficiency: 77 lumens/watt (compared with 67 lumens/watt, a 15% increase over prior art lamps).

Overall color rendition index $Ra_8=82$ (prior art: $Ra_8=76$).

Color index for red, R9: −20 (improved from prior art of −90).

Red proportion: 21% (increased from 15% of prior art).

Rated life: 6000 hours.

Scattering of color: ±130 K. (improved from ±300 K. of prior art).

Nominal chromaticity values: x=0.418, y=0.400.

Figure 2:
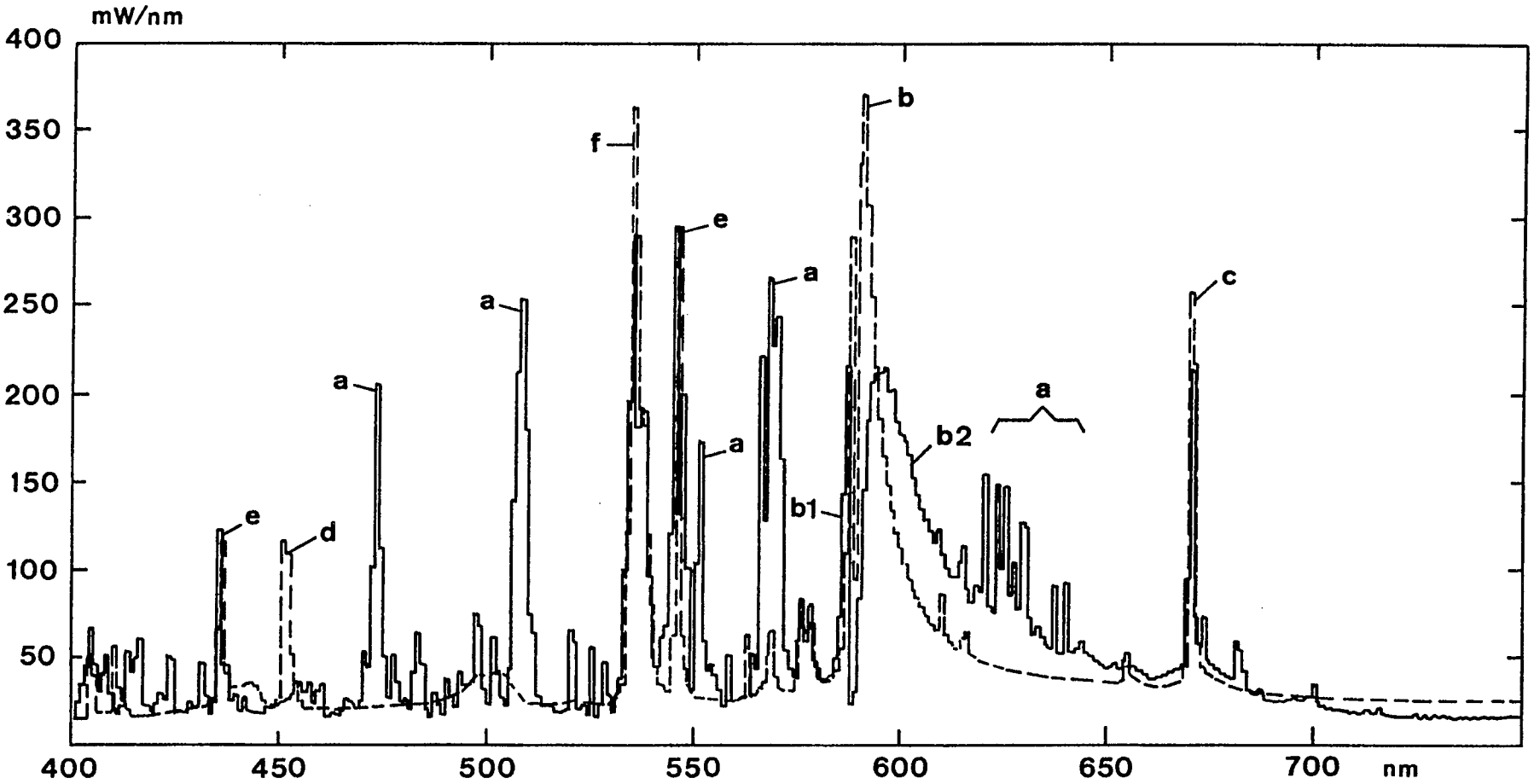

The spectral distribution of a 75 watt lamp of a known sodium tin fill is shown in broken-line representation in FIG. 2 and compared with a lamp, of equal construction, but having the sodium scandium thallium fill of Example 1 (full-line graph). The color temperature is set for 3300 K. The spectrum additionally shows single lines (a) which contribute to the improved color rendition index, and are generated by the addition of scandium. The uniformity of the spectrum is substantially improved, as can be seen by inspection of FIG. 2. Rather than single lines in the spectrum of a prior art lamp, as shown by the lines for sodium (b), lithium (c) indium (d), mercury (e) and thallium (f), the respective lines are more or less levelled. Lithium is still present as a contaminant. Particular note should be had of the substantially improved emission of the long wave wing (b2)of the sodium resonance line, which, primarily, substantially increases the proportion of red light—to about +40%. This provides for much better natural rendition of all saturated colors. (b1) is the other sodium line wing. This is of particular importance in interior room illumination, illumination of food products and of display windows.

EXAMPLE 2

A lamp, constructed similarly to Example 1, for 150 watts, with warm white light color WDL has, besides mercury and argon, overall 4 mg of the same metal halide components as in Example 1.

Color temperature: 3000 K.

Efficiency of light generation: 85 lumens/watt (prior art: 75 l/W).

Light flux: 12,800 lm.

Color rendition index $Ra_8$: 92 (prior art: 85).

Rendition in red region, R9=0 (prior art: R9=−70).

Volume of discharge vessel: 1.5 $cm^3$.

Electrode spacing: 11.0 mm.

Wall loading: 18 $W/cm^2$.

Lifetime: at least 6000 hours.

Color spread: ±130 K. (prior art: ±300 K.) .

The comparison with respect to prior art lamps relates to a fill of the metal halide, which includes iodides of dysprosium, holmium, thulium, sodium and thallium.

EXAMPLE 3

A 75 W lamp, with a fill to provide WDL light. To improve ignition and further reduce devitrification, the fill included a further additive of:

1% $HfI_4$ or ZrI

Zr, additionally, is a red color emitter; the addition of Zr I improves the color rendition index of $Ra_8$ to 90 and the red light proportion to 22%.

EXAMPLE 3*a*

Identical to Example 3, except that the NaI proportion is partially replaced by NaBr, typically by about 30% NaBr.

EXAMPLE 4

Rated power 70 W, color temperature 3000 K., for WDL light.

Excellent results are obtained with the following fill, of a total value of 2 mg, wherein the respective percentages are indicated in mol %:

58.8% NaI
34.3% NaBr
4.9% $ScI_3$
1.3% TlI
0.7% $HfI_4$.

EXAMPLE 4*a*

The lamp of Example 4, except that the fill does not contain hafnium, and, thus, will have the following composition:

59.2% NaI
34.5% NaBr
4.9% $ScI_3$
1.4% TlI.

The Na—Sc relationship is about 19:1, the Na—T1 relationship about 70:1; the bromine proportion is about 31% of the halides.

For both Examples 4 and 4*a*, light emission 77 lumens/watt, color index $Ra_8=82$, red index R9=−20. Decrease in light flux after the first 100 hours: 15% (prior art: 30%).

Decrease of color temperature by 200K (prior art: 600K).

Decrease in the y-coordinate of the chroma locus: 0.04 (prior art: 0.11) point.

EXAMPLE 5

The lamp of Example 1, with an addition of elementary scandium in a quantity of 0.03 mg. This compensates for the unavoidable loss on fill during the first 100 hours of operation, so that the color values and additionally the operating voltage constancy are improved.

EXAMPLE 5*a*

Same as Example 5, except that rather than using elementary scandium, a scandium compound such as $ScI_2$, which liberates scandium in substoichiometric quantities, is used.

The dimensions of the discharge vessels given above have an additional advantage, since they eliminate possible acoustic resonances when the lamps are operated with high frequency starter or accessory apparatus.

EXAMPLE 6

A 75 W lamp, color temperature 4000 K., for NDL fill:

81.9% NaI
14% $ScI_3$
2.7% $HfI_4$
1.4% TlI.

Mol relationship NaI/$ScI_3$ is 6:1 and NaI/TlI is 58:1.

The lamps, thus, have substantial advantages for interior room illumination by having the particularly important color temperatures in the region of about 3000 K., corresponding to a light color WDL. The thallium addition and the relative proportions are particularly important, especially for a halide relationship of sodium/thallium of between about 25:1 to 50:1 for pure iodine as the halide up to about 73:1 for mixed fills. The principle of the invention can be transferred, however, also to higher color temperatures of, for example, 4300K, corresponding to the light color NDL. In this case, of course, the influence of the thallium is reduced, so that for the higher color temperature, a halogen relationship of sodium halide to thallium halide (Na—H/Tl—H) of up to 70:1 for pure iodine as the halide is recommended, particularly preferred, however, is the relationship of between 50:1 to 65:1. For mixed fills, a relationship of between 50:1 to 73:1 is particularly suitable.

the examples are directed to particularly commercially suitable embodiments. Larger percentages of bromine may be used, for example up to 40% of the total halogen content, with the remainder being iodine, to obtain warm white light effects. For neutral white light color, the bromine may reach up to 70% of the total halogen content.

We claim:

1. A low-power, high-pressure discharge lamp, particularly for general service illumination use, comprising a discharge vessel (2) of quartz glass;

two spaced electrodes (4, 5) within the discharge vessel;

a transparent outer envelope (3) within which said discharge vessel is located;

current supply leads (8, 9) extending from the electrodes (4, 5) of the discharge vessel into the outer envelope;

connection means (10, 12, 11, 13) electrically connected to and extending from the current supply leads to the outside of the envelope for connection to a power supply;

an ionizable fill within the discharge vessel, said fill including mercury, a noble gas, and halides (H) of sodium, scandium and thallium, wherein, in accordance with the invention, the mol relationship between the sodium halide portion of the fill (Na—H) and the scandium halide portion of the fill (Sc—H) is between about 5:1 to 24:1;

the mol relationship between the sodium halide portion of the fill (Na—H) and the thallium halide portion of the fill (Tl—H) is between about 25:1 to 73:1; and wherein a heat reflective coating (15, 16) is provided, formed on the discharge vessel to effect, during operation of the lamp, heat damming or heat retention within the discharge vessel.

2. The lamp of claim 1, which, in operation, provides neutral white light color having a color temperature of from between 3800 K. to 4600 K.; and wherein the mol relation of the fill between the sodium halide (Na—H) and thallium halide (Tl—H) is between about 50:1 to 73:1.

3. The lamp of claim 1, wherein all of the halides of the fill are iodide; and wherein the mol relation of sodium halide to scandium halide is 5:1 to 13:1.

4. The lamp of claim 3, wherein the lamp, in operation, provides light with warm white (WDL) light color, corresponding to a color temperature of between 2600 to 3500 K.;

and wherein the mol relationship of the fill of sodium halide to thallium halide is 25:1 to 50:1.

5. The lamp of claim 1, wherein the halides of the fill comprise a mixture of iodides and bromides, and wherein the mol relationship of sodium halide to scandium halide is between about 8:1 to 24:1.

6. The lamp of claim 5, wherein the proportion of bromides in the halogen is up to about 70%.

7. The lamp of claim 6, which, in operation, provides a warm white light (WDL) color having a color temperature of from between 2600 K. to 3400 K., wherein the mol relation of the fill between the sodium halide (Na—H) and thallium halide (Tl—H) is between about 50:1 to 73:1;

and wherein up to about 40% of the halides are bromides.

8. The lamp of claim 1, wherein the space between the discharge vessel (2) and the envelope (3) is evacuated.

9. The lamp of claim 1, further including compounds of at least one of: hafnium (Hf) and zirconium (Zr) as a further additive to the metal halide compounds in the fill.

10. The lamp of claim 1, wherein the fill further includes elementary scandium.

11. The lamp of claim 1, wherein the discharge vessel (2) comprises a double pinch-sealed discharge vessel of substantially bulbous or ellipsoid shape defining two end caps;

and wherein said heat damming or heat retention coating (15, 16) extends about the end caps and defines end surfaces which are spaced from each other by a spacing of about 90% to 105% of the spacing (ES) between facing ends of the electrodes.

12. The lamp of claim 11, wherein the electrode spacing (ES), in millimeters, as a function of power rating (P) ,in watts,is defined by the formula:

$$ES = 0.85\ (\pm 0.1) \times \sqrt{P}\ .$$

13. The lamp of claim 1, wherein the heat damming or heat retention coating has a thickness of at least 0.15 mm.

14. The lamp of claim 13, wherein the heat damming or heat retention coating comprises at least one of: zirconium oxide; aluminum oxide.

15. The lamp of claim 1, wherein the fill proportion is selected to provide a spread sodium resonance line in a light emission spectrum and defines two wings (b1, b2) and in which the spacing between the maximum values of the two wings is between about 7 to 12 nm.

16. The lamp of claim 1, wherein the current supply leads (8, 9) extending between the discharge vessel and the connection means and positioned within the envelope are covered by a fabric (**8*a*, 9*a***) of quartz fibers, to suppress formation of photo electrons within the envelope.

17. The lamp of claim 1, wherein the power rating of the lamp is between about 35 to 200 W.

18. The lamp of claim 1, wherein the proportion of sodium halide with respect to scandium halide and thallium halide is selected such that the lamp, in operation, operates under saturated conditions with respect to the sodium halide but under unsaturated conditions with respect to the scandium halide and thallium halide.

19. The lamp of claim 1, wherein the heat damming or heat retention coating is applied with a thickness and to an extent sufficient to raise the cold spot temperature (Tc), in operation of the lamp, above 800° C.

20. The lamp of claim 1 wherein the sodium-scandium-thallium halide system is present in the interior volume of the discharge vessel (2) in a quantity of from between about 2.5 to 5.5 mg/cm$^3$.

* * * * *